US010392771B2

(12) United States Patent
Martin et al.

(10) Patent No.: US 10,392,771 B2
(45) Date of Patent: Aug. 27, 2019

(54) FOUNDATION/SIDEWALL CONSTRUCTION METHOD AND KIT

(71) Applicant: Lancia Homes, Inc., Fort Wayne, IN (US)

(72) Inventors: Mike Martin, Fort Wayne, IN (US); Chris Watt, Fort Wayne, IN (US); Jamie Lancia, Fort Wayne, IN (US)

(73) Assignee: Lancia Homes, Inc., Fort Wayne, IN (US)

( * ) Notice: Subject to any disclaimer, the term of this patent is extended or adjusted under 35 U.S.C. 154(b) by 0 days.

(21) Appl. No.: 15/428,263

(22) Filed: Feb. 9, 2017

(65) Prior Publication Data

US 2018/0223496 A1 Aug. 9, 2018

(51) Int. Cl.

| | |
|---|---|
| ***E02D 27/32*** | (2006.01) |
| ***E04B 5/32*** | (2006.01) |
| ***E04B 1/00*** | (2006.01) |
| *E04B 1/26* | (2006.01) |

(52) U.S. Cl.

CPC ..... *E02D 27/32* (2013.01); *E04B 1/0007* (2013.01); *E04B 5/32* (2013.01); *E04B 2001/2684* (2013.01); *E04B 2005/322* (2013.01)

(58) Field of Classification Search

CPC ..... E04G 9/04; E04G 11/365; E04G 13/00; E04B 5/32; E04B 2005/322; E04B 1/0007; E04B 2001/2684; E02D 27/32

USPC ..... 52/169.5, 169.11

See application file for complete search history.

(56) References Cited

U.S. PATENT DOCUMENTS

| | | | | | |
|---|---|---|---|---|---|
| 2,298,837 | A * | 10/1942 | Oswald | E02D 27/02 | 249/155 |
| 3,956,859 | A * | 5/1976 | Ingestrom | E02D 27/02 | 52/169.11 |
| 4,409,766 | A * | 10/1983 | Blackmore | E04B 1/74 | 52/169.11 |
| 4,433,720 | A * | 2/1984 | Lowstuter | E02D 27/10 | 165/45 |
| 4,538,386 | A * | 9/1985 | DiCello | E02D 31/02 | 405/43 |
| 4,683,692 | A * | 8/1987 | Tetschner | E04B 1/78 | 52/169.11 |
| 4,757,651 | A * | 7/1988 | Crites | E02D 31/02 | 137/362 |

(Continued)

FOREIGN PATENT DOCUMENTS

| | | | | |
|---|---|---|---|---|
| EP | 0528578 A1 * | 2/1993 | | E02D 27/01 |
| JP | 4133704 B2 * | 8/2008 | | |
| WO | WO-2012142660 A1 * | 10/2012 | | E04B 1/14 |

*Primary Examiner* — Adriana Figueroa

(74) *Attorney, Agent, or Firm* — Taylor IP, P.C.

(57) ABSTRACT

An architectural foundation assembly comprising a horizontal slab including a top surface, a bottom surface, and an outside surface; a vertical slab in contact with the horizontal slab, the vertical slab including a top surface, an outside surface, and an inside surface, the top surface defining a shelf having a horizontal surface and a vertical surface; and at least one structural element attached to the shelf and in contact with the top surface of the vertical slab, the at least one structural element including a top surface which is flush with the top surface of the horizontal slab, the at least one structural element not in contact with the vertical surface of the shelf, thereby creating a thermal air gap between the at least one structural element and the vertical surface of the shelf.

20 Claims, 3 Drawing Sheets

(56) References Cited

U.S. PATENT DOCUMENTS

| | | | | |
|---|---|---|---|---|
| 5,174,083 | A * | 12/1992 | Mussell | E02D 27/02 249/5 |
| 5,934,039 | A | 8/1999 | Gallagher, Jr. | |
| 6,230,468 | B1 * | 5/2001 | Klaus | E02D 31/06 405/39 |
| 6,308,470 | B1 * | 10/2001 | Durkovic | E02D 27/02 405/36 |
| 6,397,538 | B1 * | 6/2002 | Phillips | E02D 27/02 52/294 |
| 6,477,811 | B1 * | 11/2002 | Choi | E04B 1/7023 52/169.11 |
| 6,477,817 | B1 * | 11/2002 | Yurick | E04G 15/063 249/34 |
| 7,174,681 | B2 * | 2/2007 | Wilson | E02D 27/02 249/13 |
| 7,543,414 | B2 * | 6/2009 | Sourlis | E04B 1/70 52/169.5 |
| 8,011,144 | B2 * | 9/2011 | Compton | E02D 27/02 249/2 |
| 8,297,005 | B1 * | 10/2012 | Bramble | E02D 31/002 52/169.5 |
| 8,365,486 | B2 * | 2/2013 | Jablonka | E04B 1/70 52/302.1 |
| 2008/0304921 | A1 * | 12/2008 | Langley | E02D 31/00 405/270 |
| 2010/0088981 | A1 * | 4/2010 | Taraba | E02D 31/02 52/169.11 |
| 2014/0182221 | A1 * | 7/2014 | Hicks | E02D 31/00 52/169.11 |
| 2015/0101263 | A1 | 4/2015 | Price | |
| 2016/0032554 | A1 | 2/2016 | Hicks | |

* cited by examiner

FOUNDATION/SIDEWALL CONSTRUCTION METHOD AND KIT

BACKGROUND OF THE INVENTION

1. Field of the Invention

The present invention relates to architectural assemblies, and, more particularly, to an improved architectural foundation assembly method and kit.

2. Description of the Related Art

Most architectural dwellings, houses in particular, are built upon concrete slabs and footers. Insulation is often needed to address the temperature difference between the inside of the dwelling and the outside environment (which includes air and earth), as it is expensive to address the temperature differences using heating and cooling within the dwelling.

It is known to place the insulation at various parts around the slab or footer, in addition to the outside walls, but there are problems inherent in doing so. For example, if insulation is merely put on the outside of exposed footers, it can be damaged by tools used around the dwelling such as lawnmowers, weed trimmers, etc. Another disadvantage of current assemblies and methods is that expensive and/or custom materials are often needed for each individual project, and no common assembly/method can be used in most applications.

What is needed in the art is an inexpensive, easily-assembled, foundation/sidewall assembly and kit that efficiently places insulation at optimal locations.

SUMMARY OF THE INVENTION

The present invention provides an architectural foundation assembly and method of constructing the assembly, the assembly and method of assembly including a shelf created by an L-shaped form, upon which shelf a structural wall is built which includes a thermal air gap.

The present invention also provides a forming apparatus used in the method of constructing the architectural foundation assembly.

The present invention in one form is directed to an architectural foundation assembly comprising a horizontal slab including a top surface, a bottom surface, and an outside surface; a vertical slab in contact with the horizontal slab, the vertical slab including a top surface, an outside surface, and an inside surface, the top surface defining a shelf having a horizontal surface and a vertical surface; and at least one structural element attached to the shelf and in contact with the top surface of the vertical slab, the at least one structural element including a top surface which is flush with the top surface of the horizontal slab. The at least one structural element can optionally be not in contact with the vertical surface of the shelf, thereby creating a thermal air gap between the at least one structural element and the vertical surface of the shelf.

An architectural foundation assembly comprising a horizontal slab including a top surface, a bottom surface, and an outside surface; a vertical slab in contact with the horizontal slab, the vertical slab including a top surface, an outside surface, and an inside surface, the top surface defining a shelf having a horizontal surface and a vertical surface; at least one structural element attached to the shelf and in contact with the top surface of the vertical slab, the at least one structural element including a top surface which is flush with the top surface of the horizontal slab, the at least one structural element not in contact with the vertical surface of the shelf, thereby creating a thermal air gap between the at least one structural element and the vertical surface of the shelf; and a forming apparatus positioned at the top of the vertical slab for creating a shelf at the top of the vertical slab, the forming apparatus including a vertical structural element including an inside surface and a horizontal structural element including an outside surface, the outside surface of the horizontal structural element attached to the inside surface of the vertical structural element, wherein a cross-section of the forming apparatus is L-shaped.

The present invention in yet another form is directed to a method of assembling an architectural foundation assembly, comprising pouring a vertical slab including a top surface, an outside surface, and an inside surface; providing a forming apparatus including a vertical forming element including an inside surface, and a horizontal structural element including a top surface, a bottom surface, an outside surface, the outside surface of the horizontal structural element attached to the inside surface of the vertical structural element, wherein a cross-section of the forming apparatus is L-shaped; placing the forming apparatus onto the vertical slab or footer, wherein the bottom surface of the horizontal structural element contacts the top surface of the vertical slab or footer and at least part of the inside surface of the vertical forming element contacts the outside surface of the vertical slab; pouring a horizontal slab including a top surface, a bottom surface, and an outside surface, the bottom surface of the horizontal slab attached to the top surface of the vertical slab, the top surface of the horizontal slab being flush with the top surface of the horizontal structural element of the forming apparatus; removing the forming apparatus, wherein removing the forming apparatus defines a shelf having a horizontal surface and a vertical surface; and providing at least one structural element attached to the shelf and in contact with the top surface of the vertical slab, the at least one structural element including a top surface which is flush with the top surface of the horizontal slab. The at least one structural element can optionally be not in contact with the vertical surface of the shelf, thereby creating a thermal air gap between the at least one structural element and the vertical surface of the shelf.

An advantage of the present invention is that basic, common materials are used. None of the elements are custom-made.

Another advantage of the present invention is the cost to make the invention is inexpensive and not complicated.

Another advantage of the present invention is it can be used in multiple fashions and dimensions, depending upon particular needs and local/regional/national codes.

Still another advantage of the present invention is tools can be used against the vertical concrete without encountering exposed insulation, and therefore causing damage to it.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Throughout this disclosure, the terms "inside", "outside", "top", "bottom", "vertical", and "horizontal" are used. Unless otherwise stated: "inside" refers to areas facing toward the architectural construction (such as a house), "outside" refers to areas facing away from the architectural construction, "top" refers to areas facing the sky, "bottom" refers to areas facing the ground, "vertical" refers to the direction parallel to gravity, and "horizontal" refers to the direction perpendicular to gravity. These terms are considered to be non-limiting to the scope and spirit of the invention. Additionally, the invention is primarily described in a two-dimensional cross-section. It is assumed that the resulting architectural assembly will be three-dimensional, and any length or combination of lengths is within the scope and spirit of the invention.

Figure 1:
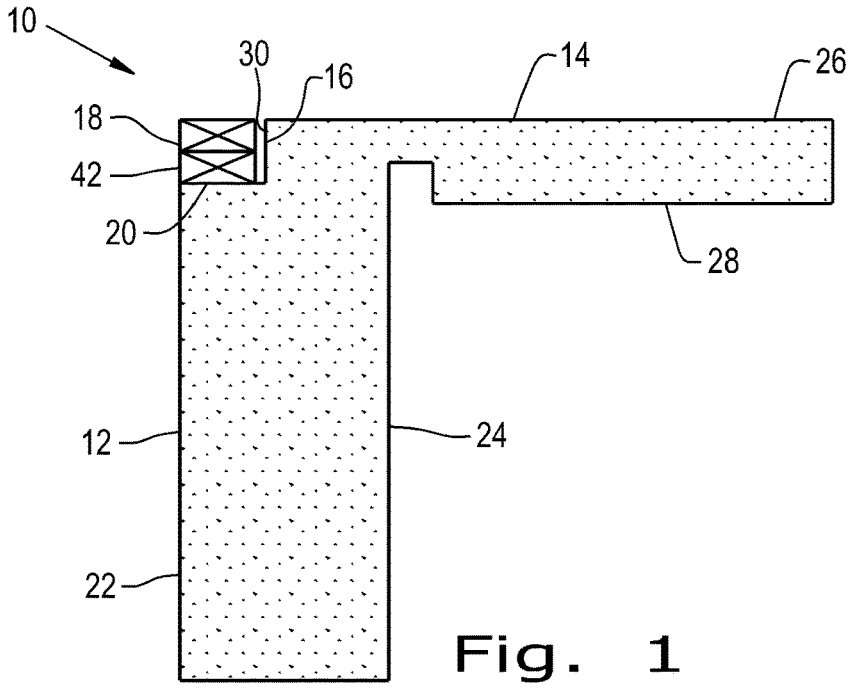
FIG. 1 is a cross-sectional schematic illustration of an embodiment of an architectural foundation assembly of the present invention.

Referring now to FIG. 1, there is shown an architectural foundation assembly 10 according to the present invention. Architectural foundation assembly 10 includes vertical slab 12, horizontal slab 14, shelf 16, and at least one structural element 18.

Vertical slab or footer 12 includes a top surface 20, an outside surface 22, and an inside surface 24. Vertical slab or footer 12 is comprised of any material suited to provide support for construction purposes, typically concrete. Horizontal slab 14 includes a top surface 26, a bottom surface 28, and an outside surface 30. Horizontal slab 14 is comprised of any material suited to provide support for construction purposes, typically concrete. The thickness of both vertical slab 12 and horizontal slab 14 will vary according to structural needs and or code requirements, but the thickness of vertical slab 12 is typically greater than the thickness of horizontal slab 14.

Figure 2:
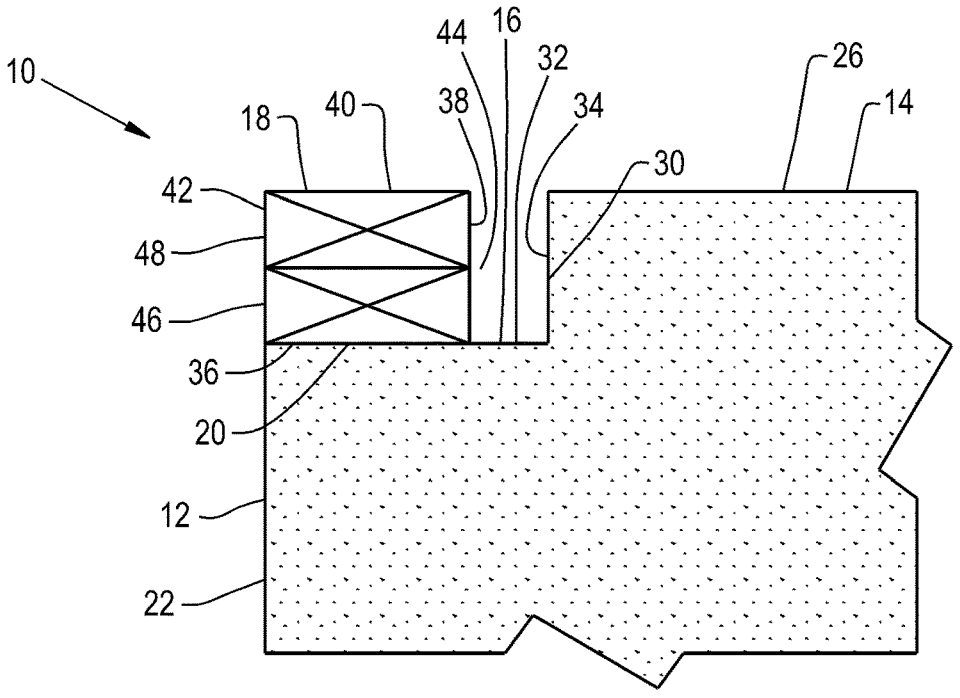
FIG. 2 is a cross-sectional schematic illustration of the shelf area of FIG. 1.

Referring now to FIG. 2 with continued reference to FIG. 1, shelf 16 and the at least one structural element 18 are detailed. Shelf 16 includes a horizontal surface 32 and a vertical surface 34. The horizontal surface 32 of shelf 16 is comprised of at least part of vertical slab top surface 20, and the vertical surface 34 of shelf 16 is comprised of at least part of horizontal slab outside surface 30.

Figure 5:
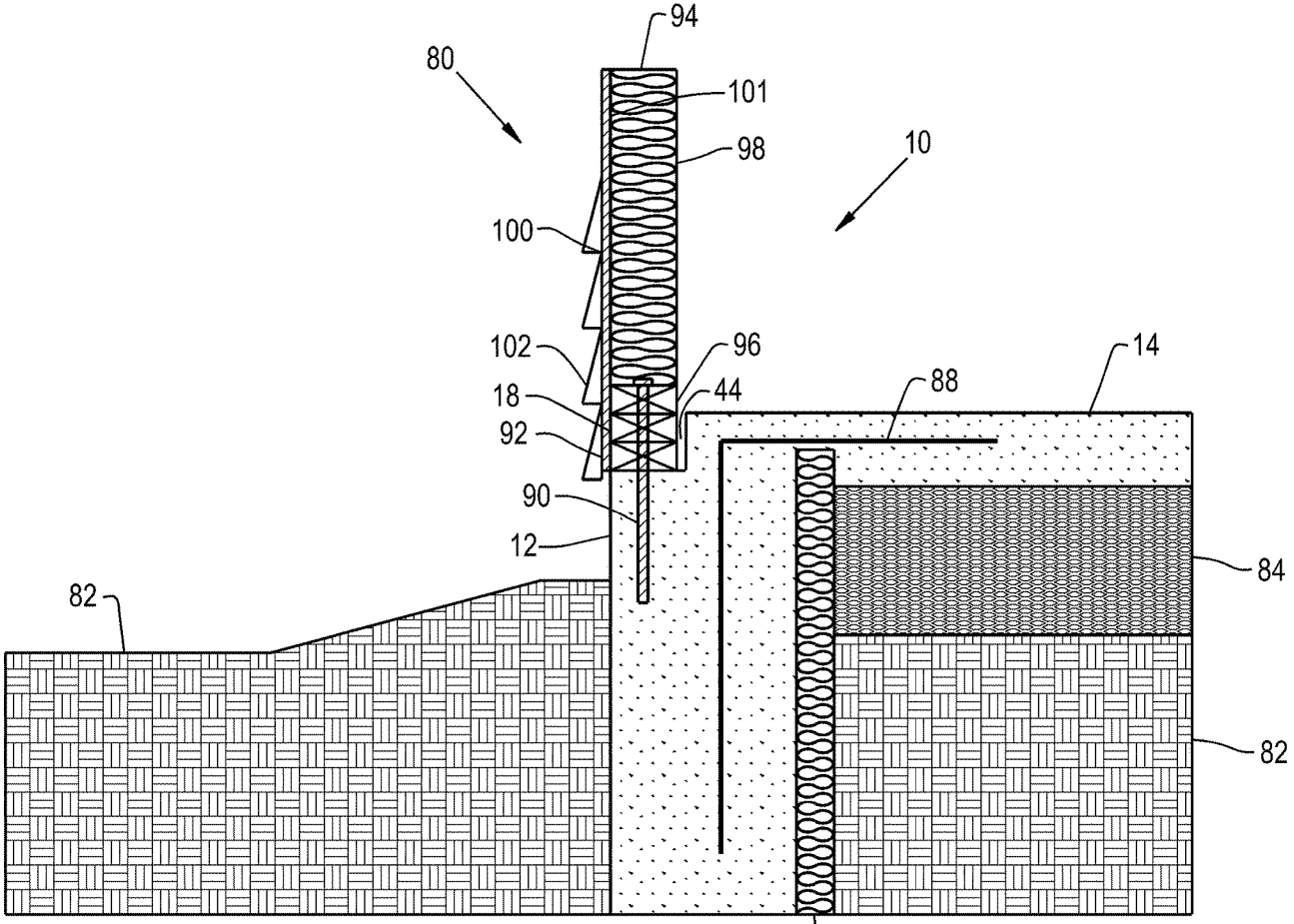
FIG. 5 is a cross-sectional schematic illustration of an embodiment of a foundation/sidewall construction of the present invention.

At least one structural element 18 includes a bottom surface 36, an inside surface 38, a top surface 40, and an outside surface 42. At least one structural element 18 is attached to shelf 16 with bottom surface of the at least one structural element 18 in contact with the shelf 16 horizontal surface 32, and therefore in contact with at least part of vertical slab 12 top surface 20. When the at least one structural element 18 is attached to shelf 16, inside surface 38 is not in contact with shelf 16 vertical surface 34, and therefore inside surface 38 is not in contact with at least part of horizontal slab 14 outside surface 30. The resulting non-contact creates a thermal air gap 44, which aids in the insulating properties of architectural foundation assembly 10. After attachment of at least one structural element 18 to shelf 16, top surface 40 is flush with horizontal slab 14 top surface 26; additionally, outside surface 42 is flush with vertical slab 12 outside surface 22. The advantageous purpose of the at least one structural element 18 being flush with horizontal slab 14 top surface 18 is that standard-length building materials such as sheet rock, plywood, and lumber can be used during the sidewall construction as shown in FIG. 5. At least one structural element 18 can be attached to shelf 16 in various ways, but typically is attached by an adhesive and/or anchor bolt (see FIG. 5). At least one structural element 18 is comprised of any material suitable for architectural construction purposes.

Advantageously and as shown in the embodiment of FIG. 2, at least one structural element 18 includes a lower structural element 46 and an upper structural element 48. In the embodiment shown, e.g., lower structural element 46 and upper structural element 48 are each comprised of "2×4" lumber (as denoted by the "nominal" dimensions); that is, they have cross-sectional dimensions of 1.5 inches vertically and 3.5 inches horizontally. Lower structural element 46 can be any length, and is advantageously comprised of pressure treated wood. Upper structural element 48 can be any length, and is advantageously comprised of untreated wood or alternatively pressure treated wood. Lower structural element 46 is place upon shelf 16, and then upper structural element 48 is placed upon lower structural element 46.

Advantageously and as shown in the embodiment of FIG. 2, horizontal surface 32 of shelf 16 is 4 inches and vertical surface 34 of shelf 16 is 3 inches. Therefore, when lower structural element 46 and upper structural element 48 are attached to shelf 16 as described above, the resulting thermal air gap 44 has cross-directional dimensions of, e. g., 0.5 inches horizontally and 3 inches vertically. Although one embodiment with specific dimensions has been disclosed, at least one structural element 18 and shelf 16 may include many other combinations and remain within the spirit and scope of the invention.

Figure 3:
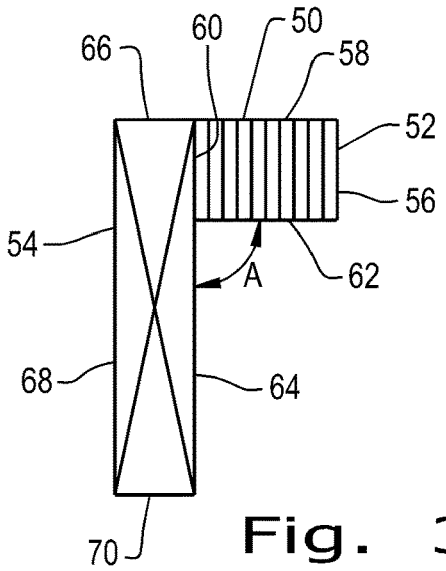
FIG. 3 is a cross-sectional schematic illustration of an embodiment of a forming apparatus of the present invention.
Figure 4:
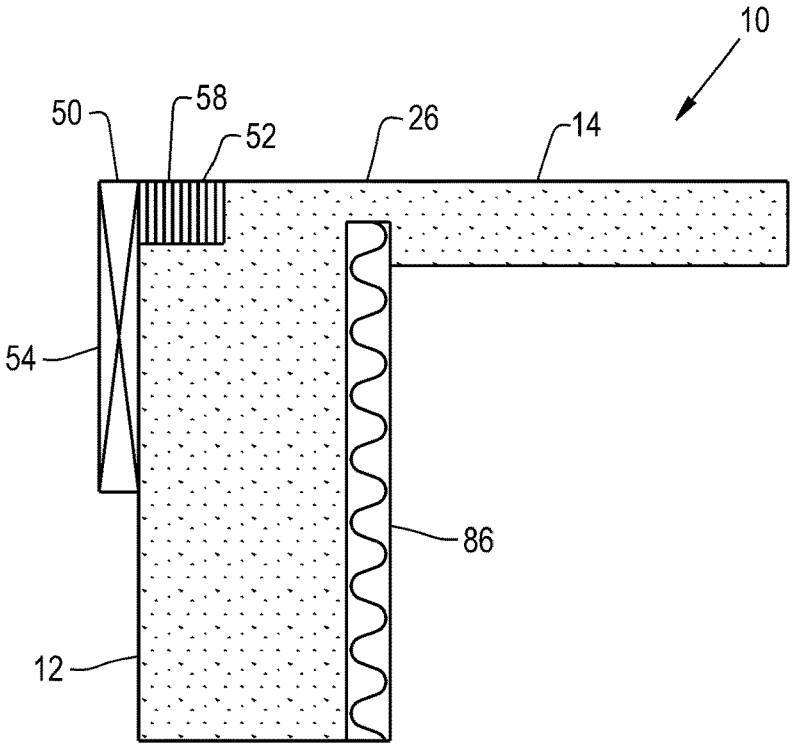
FIG. 4 is a cross-sectional schematic illustration of the forming apparatus of FIG. 3 in use.

Now referring to FIGS. 3 and 4, a forming apparatus 50 for creating shelf 16 is described. Forming apparatus 50 includes horizontal structural element 52 and vertical structural element 54. Horizontal structural element 52 includes inside surface 56, top surface 58, outside surface 60, and bottom surface 62. Vertical structural element 54 includes inside surface 64, top surface 66, outside surface 68, and bottom surface 70. To construct forming apparatus 50, outside surface 60 of horizontal structural element 52 is attached to inside surface 64 of vertical structural element 54 at a 90-degree angle A, thereby forming an L-shape.

Advantageously and as shown in the embodiment of FIG. 3, horizontal structural element 52 is comprised of laminated strand lumber (LSL) and has dimensions of 4 inches horizontally and 3 inches vertically. Vertical structural element 54 is comprised of "2×12" lumber (as denoted by the "nominal" dimensions); that is, they have cross-sectional dimensions of 1.5 inches horizontally and 11.25 inches vertically. Horizontal structural element 12 (FIGS. 1, 2, 4 and 5) may further include through-holes (not shown) in order to allow forming apparatus 50 to fit over anchor bolts 90 (see FIG. 5 and description below).

With continued reference to FIGS. 1-4, a method of constructing architectural foundation assembly 10 is described. After a suitable site is selected and a trench is dug with the desired width and depth, vertical slab 12 is poured against first insulation 86 and allowed to dry. As shown in FIG. 4, forming apparatus 50 is then placed on top of and against vertical slab or footer 12, and horizontal slab 14 is poured until horizontal slab top surface 26 is flush with top surface 58 of horizontal structural element 52 of forming apparatus 50. After horizontal slab 14 is dry, forming apparatus 50 is removed, leaving shelf 16. As shown in FIG. 2, at least one structural element 18 is then attached to shelf 16 with outside surface 42 of at least one structural element 18 flush with outside surface 22 of vertical slab 12, thereby creating a thermal air gap 44 between inside surface 38 of at least one structural element 18 and horizontal slab 14 outside surface 30.

Alternatively, vertical slab 12 and horizontal slab 14 can be poured at the same time or one shortly after the other.

With continued reference to FIGS. 1-4 and now referring to FIG. 5, an inventive foundation/sidewall construction 80 is illustrated. Foundation/sidewall construction 80 includes architectural foundation assembly 10, earth 82, granular fill 84, first insulation 86, rebar 88, anchor bolts 90, second insulation 92, and sidewall assembly 94.

Vertical slab 12 is surrounded by earth 82, and may advantageously contact first insulation 86 disposed between its inside surface 24 and earth 82 as illustrated. First insulation 86 advantageously is vertically higher than shelf horizontal surface 32 in order to provide thermal transfer between the outside and inside of a dwelling. A minimum of two inches of concrete, or more/less concrete according to code, must be present between the top of first insulation 86 and the horizontal portion of rebar 88. Horizontal slab 14 is at least partially disposed upon first insulation 86 and granular fill 84. First insulation 86, therefore, contacts earth 82, granular fill 84, and horizontal slab 14 as well as vertical slab 12. First insulation 86 may comprise a rigid material.

As shown in FIG. 5, rebar 88 is used to help connect horizontal slab 14 and vertical slab 12. Typically, rebar 88 is placed into vertical slab 12 immediately after pouring and prior to drying. Horizontal slab 14 is then poured on and around rebar 88.

Sidewall assembly 94 includes plate 96, sidewall insulation 98, sheathing 100, house wrap 101, and siding 102. Plate 96 is typically an untreated horizontal length of 2×4 lumber placed upon the at least one structural element 18, upon which a structure of additional vertical 2×4's (not shown) and sidewall insulation 98 is constructed. As shown in FIG. 5, anchor bolts 90 are used to attach plate 96 and at least one structural element 18 to vertical slab 12. Anchor bolts 90 can be pre-embedded in vertical slab or footer 12 (that is, put into place immediately after pouring and before hardening), or they can be placed after the poured vertical slab 12 has hardened. If anchor bolts 90 are put into the non-hardened vertical slab 12, it may be necessary to have through-holes in forming apparatus 50 for clearance as it is placed on vertical slab 12. If anchor bolts 90 are put into the hardened vertical slab 12, through-holes in forming apparatus 50 are used to indicate locations for anchor bolts 90 as well as provide clearance for them to be inserted into vertical slab 12.

To complete construction of sidewall assembly 94 upon architectural foundation 10, sheathing 100 is added over the outside of plate 96 and the 2×4/sidewall insulation 98. Second insulation 92 is then attached to the outside of the at least one structural element 18. Second insulation 92 may comprise a rigid material.

Foundation/sidewall construction 80, as shown in FIG. 5, therefore provides a well-insulated assembly with temperature change protection at the vertical slab 12, horizontal slab 14, sidewall assembly 94, and at least one structural element 18. Additionally, an advantageous thermal air gap 44 is provided.

While architectural foundation assemblies have been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An architectural foundation assembly, comprising:

a horizontal slab including a top surface, a bottom surface, and an outside surface;

a vertical slab in contact with the horizontal slab, the vertical slab including a top surface, an outside surface, and an inside surface, the top surface of the vertical slab and at least part of the outside surface of the horizontal slab forming a shelf with a horizontal surface and a vertical surface, respectively; and at least one structural element having a bottom surface, an inside surface and an outside surface, the bottom surface attached to and in contact with the horizontal surface of the shelf, the at least one structural element including a top surface which is flush with the top surface of the horizontal slab, and the inside surface of the at least one structural element and the outside surface of the horizontal slab forming a thermal air gap therebetween, and the thermal air gap extending continuously and uninterrupted along the outside surface of the horizontal slab.

2. The architectural foundation assembly of claim 1, wherein the shelf measures 4 inches horizontally and 3 inches vertically.

3. The architectural foundation assembly of claim 1, wherein the at least one structural element includes two structural elements, a cross-section of each structural element measuring 3.5 inches horizontally and 1.5 inches vertically.

4. The architectural foundation assembly of claim 1, wherein the at least one structural element further includes an outside surface which is flush with the outside surface of the vertical slab or footer.

5. The architectural foundation assembly of claim 1, wherein the at least one structural element is comprised of pressure treated wood.

6. The architectural foundation assembly of claim 1, wherein a cross-section of the thermal air gap measures 0.5 inches horizontally and 3 inches vertically.

7. The architectural foundation assembly of claim 1, wherein insulation is attached to the outside surface of the at least one structural element.

8. The architectural foundation assembly of claim 1, wherein insulation is in contact with at least part of the inside surface of the vertical slab.

9. An architectural foundation assembly, comprising:

a horizontal slab including a top surface, a bottom surface, and an outside surface;

a vertical slab in contact with the horizontal slab, the vertical slab including a top surface, an outside surface, and an inside surface, the top surface of the vertical slab and at least part of the outside surface of the horizontal slab forming a shelf with a horizontal surface and a vertical surface, respectively;

at least one structural element having a bottom surface, an inside surface and an outside surface, the bottom surface attached to and in contact with the horizontal surface of the shelf, the at least one structural element including a top surface which is flush with the top surface of the horizontal slab, the inside surface of the at least one structural element and the outside surface of the horizontal slab forming a thermal air gap therebetween, and the thermal air gap extending continuously and uninterrupted along the outside surface of the horizontal slab; and a forming apparatus positioned at the top of the vertical slab or footer for creating a shelf at the top of the vertical slab or footer, the forming apparatus including:

a vertical structural element including an inside surface; and a horizontal structural element including an outside surface, the outside surface of the horizontal structural element attached to the inside surface of the vertical structural element, wherein a cross-section of the forming apparatus is L-shaped.

10. The architectural foundation assembly of claim 9, wherein a cross-section of the vertical structural element of the forming apparatus measures 1.5 inches horizontally and 11.25 inches vertically.

11. The architectural foundation assembly of claim 9, wherein a cross-section of the horizontal structural element of the forming apparatus measures 4 inches horizontally and 3 inches vertically.

12. The architectural foundation assembly of claim 9, wherein the horizontal structural element of the forming apparatus is comprised of laminated strand lumber (LSL).

13. A method of assembling an architectural foundation assembly, comprising:

pouring a vertical slab or footer including a top surface, an outside surface, and an inside surface;

providing a forming apparatus including:

a vertical forming element including an inside surface; and a horizontal structural element including:

a top surface;

a bottom surface; and an outside surface, the outside surface of the horizontal structural element attached to the inside surface of the vertical structural element, wherein a cross-section of the forming apparatus is L-shaped;

placing the forming apparatus onto the vertical slab or footer, wherein the bottom surface of the horizontal structural element contacts the top surface of the vertical slab and at least part of the inside surface of the vertical forming element contacts the outside surface of the vertical slab or footer;

pouring a horizontal slab including a top surface, a bottom surface, and an outside surface, the bottom surface of the horizontal slab in contact with the top surface of the vertical slab or footer, the top surface of the horizontal slab being flush with the top surface of the horizontal structural element of the forming apparatus;

removing the forming apparatus, wherein removing the forming apparatus defines a shelf having a horizontal surface comprised of the vertical slab top surface and a vertical surface comprised of at least part of the outside surface of the horizontal slab; and providing at least one structural element having a bottom surface, an inside surface and an outside surface, the bottom surface attached to and in contact with the horizontal surface of the shelf, the at least one structural element including a top surface which is flush with the top surface of the horizontal slab, the inside surface of the at least one structural element and the outside surface of the horizontal slab forming a thermal air gap therebetween, and the thermal air gap extending continuously and uninterrupted along the outside surface of the horizontal slab.

14. The method of claim 13, wherein the shelf measures 4 inches horizontally and 3 inches vertically.

15. The method of claim 13, wherein the at least one structural element includes two structural elements, a cross-section of each structural element measuring 3.5 inches horizontally and 1.5 inches vertically.

16. The method of claim 13, wherein the at least one structural element further includes an outside surface which is flush with the outside surface of the vertical slab or footer.

17. The method of claim 13, wherein a cross-section of the thermal air gap measures 0.5 inches horizontally and 3 inches vertically.

18. The method of claim 13, further comprising the step of attaching insulation to the outside surface of the at least one structural element.

19. The method of claim 13, wherein a cross-section of the horizontal forming element measures 4 inches horizontally and 3 inches vertically.

20. The method of claim 13, wherein a cross-section of the vertical structural element measures 1.5 inches horizontally and 11.25 inches vertically.

* * * * *